United States Patent [19]

Asano

[11] 4,208,990

[45] Jun. 24, 1980

[54] ELECTRONIC CLOSED LOOP AIR-FUEL RATIO CONTROL SYSTEM

[75] Inventor: Masaharu Asano, Yokosuka, Japan

[73] Assignee: Nissan Motor Compmany, Limited, Yokohama, Japan

[21] Appl. No.: 795,237

[22] Filed: May 9, 1977

[30] Foreign Application Priority Data

May 10, 1976 [JP] Japan ..... 51-52103

[51] Int. Cl.[2] ..... F02B 5/02

[52] U.S. Cl. ..... 123/32 EE; 123/119 EC; 60/276

[58] Field of Search ..... 123/32 EA, 32 EE, 119 EC, 123/119 L; 60/276, 285

[56] References Cited

U.S. PATENT DOCUMENTS

| | | | |
|---|---|---|---|
| 3,938,479 | 2/1976 | Oberstadt | 123/32 EA |
| 4,019,470 | 4/1977 | Asano | 123/119 EC |
| 4,027,477 | 6/1977 | Storey | 123/32 EE |
| 4,029,061 | 6/1977 | Asano | 123/32 EE |
| 4,046,118 | 9/1977 | Aono | 123/32 EE |
| 4,112,880 | 9/1978 | Asano et al. | 123/119 EC |
| 4,117,815 | 10/1978 | Ikeura | 123/119 EC |

FOREIGN PATENT DOCUMENTS

| | | | |
|---|---|---|---|
| 2529797 | 4/1979 | Fed. Rep. of Germany | 123/32 EA |

*Primary Examiner*—Samuel W. Engle
*Assistant Examiner*—S. A. Cangialosi
*Attorney, Agent, or Firm*—Schwartz, Jeffery, Schwaab, Mack, Blumenthal & Koch

[57] ABSTRACT

The operation of an electronic closed loop air-fuel ratio control system is inhibited while exhaust gas temperature is low, and a rich air-fuel mixture is intermittently fed to an internal combustion engine in order to properly initiate the operation of the system.

10 Claims, 11 Drawing Figures

ELECTRONIC CLOSED LOOP AIR-FUEL RATIO CONTROL SYSTEM

BACKGROUND OF THE INVENTION

1. Field of the Invention

The present invention relates generally to an electronic closed loop air-fuel ratio control system for use with an internal combustion engine, and particularly to an improvement in such a system for properly initiating the operation of the system in consideration of exhaust gas temperature.

2. Description of the Prior Art

Various systems have been proposed to supply an optimal air-fuel mixture to an internal combustion engine in accordance with the mode of engine operation. One such system is to utilize the concept of an electronic closed loop control system based on a sensed concentration of a component in exhaust gases of the engine.

According to the conventional system, an exhaust gas sensor, such as an oxygen analyzer, is deposited in an exhaust pipe for sensing a component of exhaust gases from an internal combustion engine, and for generating an electrical signal respresentative of the sensed component. A differential signal generator is connected to the sensor for generating an electrical signal representative of a differential between the signal from the sensor and a reference signal. The reference signal is previously determined in due consideration of, for example, an optimum ratio of an air-fuel mixture to the engine for maximizing the efficiency of both the engine and an exhaust gas refining means. A so-called proportional-integral (p-i) controller is connected to the differential signal generator, receiving the signal therefrom, and generating a signal therefrom. A pulse generator is connected to the p-i controller for receiving the signal therefrom and for generating a train of pulses based on the signal received. These pulses are fed to an air-fuel ratio regulating means, such as electromagnetic valves, for supplying an air-fuel mixture with an optimum air-fuel ratio to the engine.

In the previously described conventional control system, however, a problem is encountered as follows. The output voltage of the exhaust gas sensor is considerably low when the exhaust gas temperature is low during idling or during continuing low engine speed operation. Therefore, according to the prior art, the operation of the air-fuel ratio control system is inhibited until the output voltage of the exhaust gas sensor rises up to a predetermined level. However, if, for example, an oxygen analyzer is used as the exhaust gas sensor and the air-fuel mixture fed to the engine is lean, then the output voltage of the exhaust gas sensor is low in spite of the fact that the exhaust gas temperature is sufficiently high. Therefore, the operation of the conventional air-fuel ratio control system can not be properly initiated in that it is not exactly determined whether or not the actual low output voltage of the exhaust gas sensor results from the low temperature of the exhaust gas. Proposals to obviate the above described defect of the prior art, have not proven practical or satisfactory.

SUMMARY OF THE INVENTION

It is therefore an object of the present invention to provide an improved electronic closed loop air-fuel ratio control system for removing the above described inherent defect of the conventional system.

Another object of the present invention is to provide an improved electronic closed loop air-fuel ratio control system which generates a pulsating signal for making the air-fuel mixture fed to an internal combustion engine rich while the system is inhibited due to a low output voltage of the exhaust gas sensor.

BRIEF DESCRIPTION OF THE DRAWINGS

These and other objects, features and many of the attendant advantages of this invention becomes better understood by the following detailed description, wherein like parts in each of the several figures are identified by the same reference characters, and wherein.

DETAILED DESCRIPTION OF THE PREFERRED EMBODIMENTS

Figure 1:
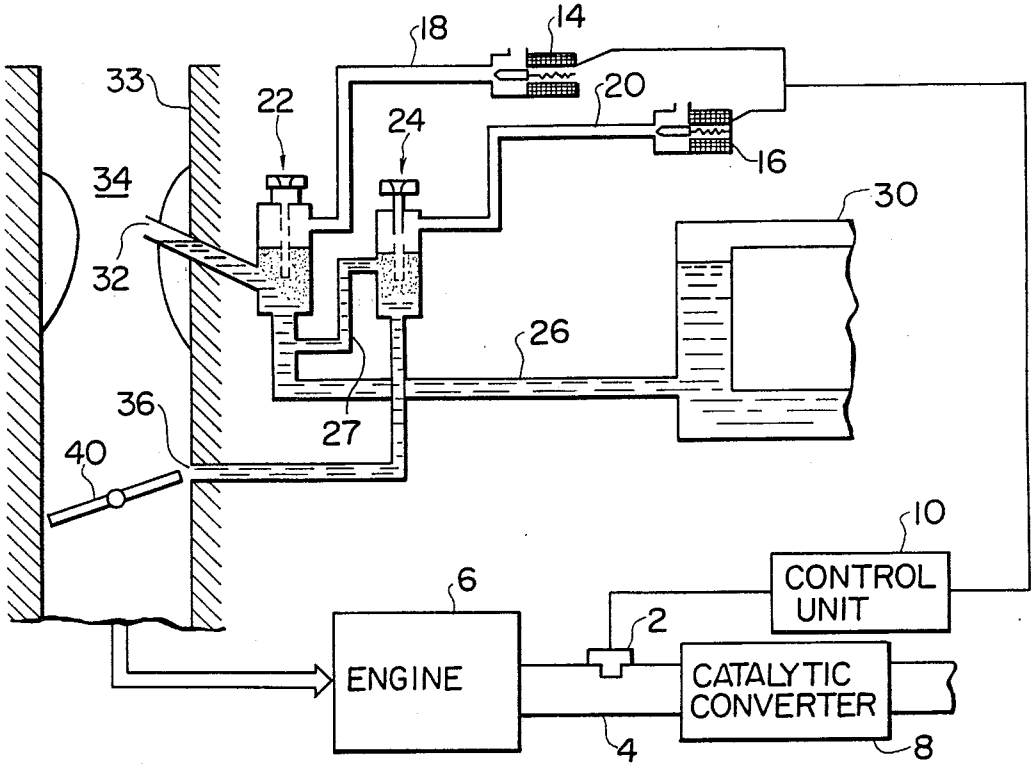
FIG. 1 schematically illustrates a conventional electronic closed loop air-fuel ratio control system for regulating the air-fuel ratio of the air-fuel mixture fed to an internal combustion engine.

Reference is now made to drawings, first to FIG. 1, which schematically exemplifies in a block diagram a conventional electronic closed loop control system with which the present invention is concerned. The purpose of the system of FIG. 1 is to electrically control the air-fuel ratio of an air-fuel mixture supplied to an internal combustion engine 6 through a carburetor (no numeral). An exhaust gas sensor 2, such as an oxygen, CO, HC, $NO_x$, or $CO_2$ analyzer, is disposed in an exhaust pipe 4 in order to sense the concentration of a component of the exhaust gases. An electrical signal from the exhaust gas sensor 2 is fed to a control unit 10, wherein it is compared with a reference signal to generate a signal representing a differential therebetween. The magnitude of the reference signal is previously determined in due consideration of an optimum air-fuel ratio of the air-fuel mixture supplied to the engine 6 for maximizing the efficiency of a catalytic converter 8. The control unit 10, then, generates a command signal, or in other words, a train of command pulses based on the signal representative of the optimum air-fuel ratio. The command signal is employed to drive two electromagnetic valves 14 and 16. The control unit 10 is described in more detail in conjunction with FIG. 2.

The electromagnetic valve 14 is provided in an air passage 18, which terminates at one end thereof at an air bleed chamber 22, to control the rate of air flowing into the air bleed chamber 22 in response to the command pulses from the control unit 10. The air bleed chamber 22 is connected to a fuel passage 26 for mixing air with fuel delivered from a float bowl 30. The air-fuel mixture is supplied to a venturi 34 through a discharging (or main) nozzle 32. The other electromagnetic valve 16 is provided in another air passage 20, which terminates at one end thereof at another air bleed chamber 24. Similarly, the rate of air flowing into the air bleed chamber 24 is controlled in response to the command pulses from the control unit 10. The air bleed chamber 24 is connected to the fuel passage 26 through a fuel branch passage 27 for mixing air with fuel from the float bowl 30. The air-fuel mixture is supplied to an intake passage 33 through a slow nozzle 36 adjacent to a throttle 40. As shown, the catalytic converter 8 is provided in the exhaust pipe 4 downstream of the exhaust gas sensor 2. In the case where, for example, a three-way catalytic converter is employed, the electronic closed loop control system is designed to set the air-fuel ratio of the air-fuel mixture to about stoichiometry. This is because the three-way catalytic converter is able to simultaneously and most effectively reduce nitrogen oxides ($NO_x$), carbon monoxide (CO), and hydrocarbons (HC), only when the air-fuel mixture ratio is set at about stoichiometry. It is apparent, on the other hand, that, when other catalytic converter such as an oxidizing or deoxidizing type is employed, case by case setting of an air-fuel mixture ratio, which is different from the above, will be required for effective reduction of noxious component(s).

Figure 2:
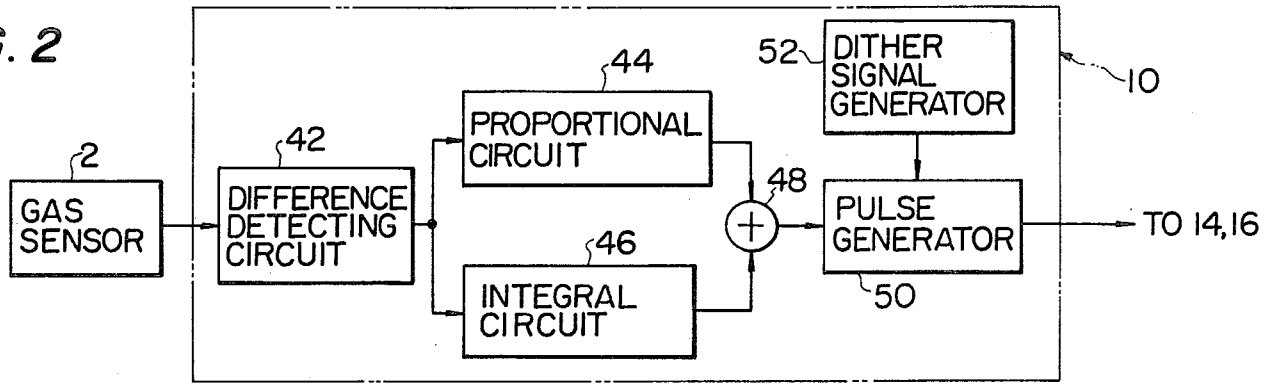
FIG. 2 is a detailed block diagram of an element used in the system of FIG. 1.

Reference is now made to FIG. 2 wherein a detailed arrangement of the control unit 10 is schematically exemplified. The signal from the exhaust gas sensor 2 is fed to a difference detecting circuit 42 of the control unit 10, which circuit compares the incoming signal with a reference to generate a signal representing a difference therebetween. The signal from the difference detecting circuit 42 is then fed to two circuits, viz., a proportional circuit 44 and an integration circuit 46. The purpose of the provision of the proportional circuit 44 is, as is well known to those skilled in the art, to increase the response characteristics of the system, and the purpose of the integration circuit 46 is to stabilize the operation of the system and to generate an integrated signal which is used in generating the command pulses in a pulse generator 50. The signals from the circuit 44 and 46 are then fed to an adder 48 in which the two signals are added. The signal from the adder 48 is then applied to the pulse generator 50 to which a dither signal is also fed from a dither signal generator 52. The command signal, which is in the form of pulses, is fed on the valves 14 and 16, thereby to control the "on" and "off" operation thereof.

In FIGS. 1 and 2, the electronic closed loop air-fuel ratio control system is illustrated together with a carburetor, however, it should be noted that the system is also applicable to a fuel injection device.

In the above described conventional air-fuel ratio control system, when the exhaust gas temperature is low, the output voltage of the exhaust gas sensor is considerably low so that the air-fuel ratio control can not be properly carried out. Therefore, the operation of the system is inhibited until the maximum or the average value of the output voltage of the exhaust gas sensor rises up to a predetermined level.

In the above, if an $O_2$ sensor is used as the exhaust gas sensor and the exhaust gas temperature is below about 400° C., the output voltage of the sensor can not be used as a proper input to the air-fuel ratio control system due to its low value.

Figure 3:
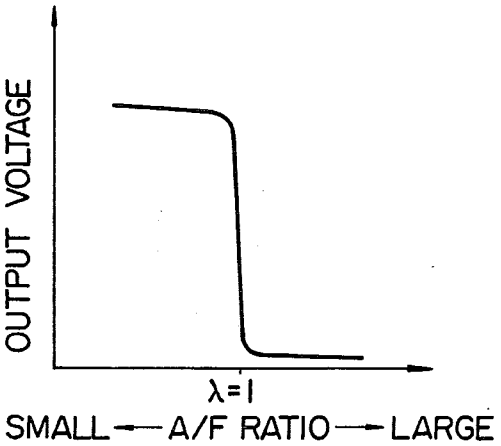
FIG. 3 is a graph showing an output voltage of an exhaust gas sensor as a function of an air-fuel ratio.

On the other hand, as shown in FIG. 3, the output voltage of the $O_2$ sensor abruptly changes in the vicinity of stoichiometry ($\lambda=1$). Therefore, when the air-fuel mixture fed to the engine is greater than the stoichiometry, the output voltage of the sensor is considerably low even though the exhaust gas temperature is high. This means that the operation of the system can not be properly initiated in that it is impossible to determine whether or not the low output voltage of the exhaust gas sensor results from the low exhaust gas temperature. In order to remove this defect, according to the prior art, the rich air-fuel mixture is purposely and continuously fed to the engine while the operation of the control system is inhibited. However, it has been difficult to certainly supply the engine with a predetermined rich air-fuel mixture during the inhibitation due to scattered characteristics of elements used in the system. As for example, in electronic controlled fuel injection systems, each of exhaust gas sensors employed has about ±5% scattering with respect to the air-fuel ratio, and, on the other hand, each of control units and each of injection valves have about ±2% and ±3% scatterings, respectively. Accordingly, the total scattering of each of the fuel injection systems is up to about 35 10% concerning the air-fuel ratio. The air-fuel ratio is clamped at a predetermined level during the inhibitation of the operation of the system. If the air-fuel ratio is 10% richer than the clamped level, there is an undesirable possibility that the engine actually receives the air-fuel mixture 20% richer than that determined by the clamped level.

The present invention removes the aforesaid inherent defect in the prior art.

Figure 4:
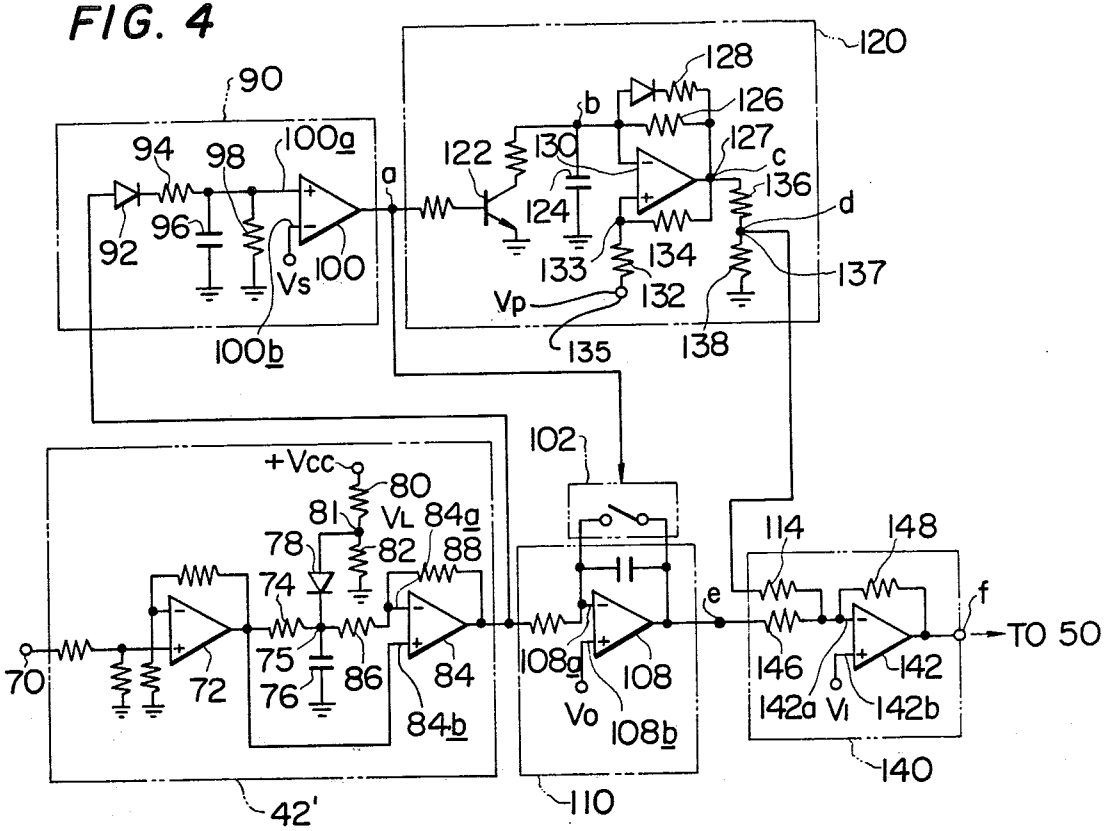
FIG. 4 is a first preferred embodiment of the present invention.

Reference is now made to FIGS. **4–5*f*, wherein FIG. 4 illustrates a first preferred embodiment of the present invention, and FIGS. 5*a*–5*f* show waveforms of signals appearing at various points of the circuit of FIG. 4**, which points are denoted by reference characters "a'-'-"f", respectively.

The exhaust gas sensor 2 (FIGS. 1 and 2) is connected through input terminal 70 to an operational amplifier 72 of a difference detecting circuit 42', which corresponds to the circuit 42 in FIG. 2. The signal from terminal 70 is amplified at the amplifier 72 and then fed to an averaging circuit, which consists of a resistor 74 and a capacitor 76. The signal with the averaged value is then fed to an inverting input terminals **84*a* of an operational amplifier 84 through a resistor 86 as a reference value. A junction 75 between the resistor 74 and the capacitor 76 is connected to the cathode of a diode 78, and, the anode of the diode 78 is then connected to a junction 81 of a voltage divider consisting of resistors 80 and 82, across which a predetermined potential $V_{cc}$ is applied for providing the junction 81 with a voltage $V_L$. It is therefore understood that the voltage applied to the inverting input terminal 84*a* does not fall below the potential $V_L$. The voltage appearing at the junction 75 is, as previously referred to, used as a reference value of a differential amplifier 84 consisting of the operational amplifier 84 and resistors 86 and 88. As shown, a non-inverting input terminal 84*b* of the amplifier 84 is directly connected to the output terminal (no numeral) of the amplifier 72. The amplifier 84 thus receives the two signals at the input terminals 84*a* and 84*b* and then generates a signal representative of a difference between the magnitudes of the signals received. The averaging circuit, which consists of the resistor 74 and the capacitor 76, compensates for output characteristic change of the exhaust gas sensor 2** due to exhaust gas temperature change and/or a change with the passage of time.

Figures 5A, 5B, 5C, 5D, 5E, 5F:
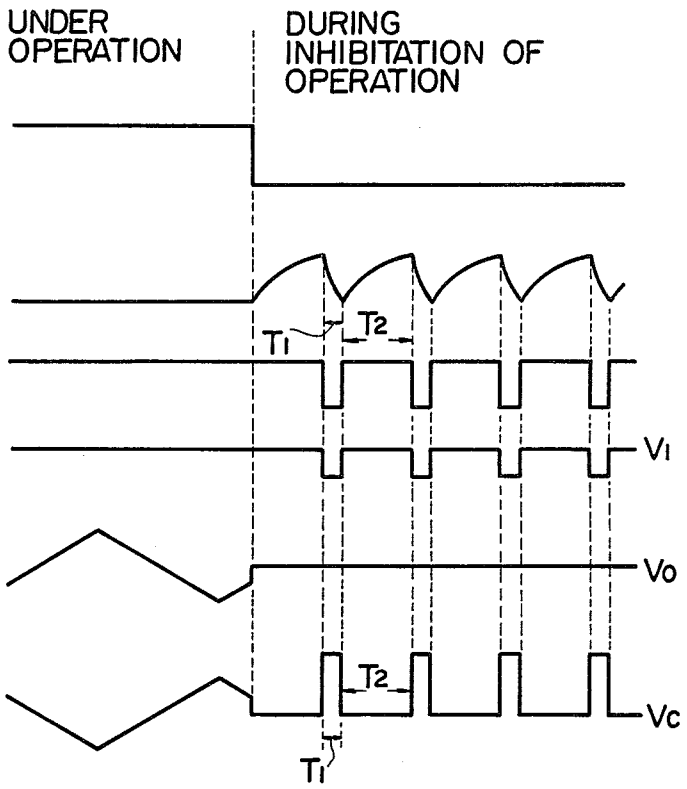
FIGS. 5*a*–5*f* each shows a waveform of a signal appearing at a point of FIG. 4.

The difference representative signal from the amplifier 84 is fed to the anode of a diode 92 of a discriminator 90, and thence smoothed by resistors 94 and 98 and a capacitor 96. The smoothed signal is then applied to a non-inverting input terminal 100*a* of an operational amplifier 100, which serves as a comparator for comparing same with a voltage $V_s$ applied to an inverting input terminal 100*b*. The comparator 100 generates at a point "a" a signal which has a high value when the magnitude of the signal applied to the comparator 100 at the terminal 100*a* is more than the voltage $V_s$, and a low value when this signal is less than the voltage $V_s$. The waveform of the signal appearing appearing at the point "a" is shown in FIG. 5*a*. The output terminal (no numeral) of the comparator 100 is connected to a suitable switching means 102 of an integrator 110 which opens and closes in response to the high and the low values of the signal from the comparator 100, respectively. This means that, if the signal from the exhaust gas sensor 2 has a low value such that the magnitude of the signal applied to the non-inverting input terminal 100*a* is below the voltage $V_s$, then, the switching means 102 closes with the result that the integrator 110 becomes inoperative, whilst, if the signal from the exhaust gas sensor 2 has a high value such that the magnitude of the signal applied to the non-inverting input terminal 100*a* is above the voltage $V_s$, then, the switching means 102 opens causing the integrator 110 to integrate the signal from the operational amplifier 84. The function of the integrator 110 will be discussed in more detail below.

The signal from the comparator 100 is fed to the control electrode of a transistor 122 of a pulse generator 120, rendering the transistor 122 conductive and non-conductive when the signal in question takes the higher and the lower values, respectively. When transistor 122 is conducting the signal generator 120 stops generating a train of pulses. This means that, when the exhaust gas temperature rises to the extent that the air-fuel ratio control system properly functions, it is no longer required that the pulse generator 120 generates pulses therefrom. On the other hand, while transistor 122 is non-conductive, a capacitor 124 is charged and discharged by means of an operational amplifier 130 and its peripheral elements, generating a signal the waveform of which is shown in FIG. 5*b*, wherein a charging time constant is determined by the resistance of a resistor 126 and the capacitance of the capacitor 124, and a discharging time constant is determined by the resistances of resistors 128 and 126 and the capacitance of the capacitor 124. In FIG. 5*b*, a time period T1 is determined by the resistances of resistors 132 and 134, a d.c. voltage $V_p$ applied to a terminal 135, and the above-mentioned discharging time constant. The output voltage of the operational amplifier 130 takes a higher and a lower value as shown in FIG. 5*c*. Therefore, a signal appearing at a junction 137 has a waveform as shown in FIG. 5*d*. Resistors 136 and 138 serves to regulate the aforementioned clamp level which is used to determine the air-fuel ratio while the operation of the system is inhibited.

Returning to the integrator 110, when the switch 102 closes in response to the lower value of the signal from the discriminator 90, a signal from an operational amplifier 108 has, at its output, a contant voltage $V_o$, which is received through a non-inverting input terminal 108*b*, as shown in FIG. 5*d*. As previously described, when the discriminator 90 generates a low signal, the pulse generator 120 generates the pulses as shown in FIG. 5*d*. The higher value of the signal from the point "d" is previously determined to be equal to a voltage $V_1$ which is fed to a non-inverting input terminal 142*b* of an operational amplifier 142 of an adder 140. Therefore, the signal from the amplifier 142 or at a point "f" takes a lower value $V_c$ (clamp level, $=V_1+(R_{148}/R_{146})(V_1-V_o)$ when the magnitude of the signal from the point "d" is a higher level $V_1$, and takea a higher value $V_2$ $(=V_c+(R_{148}/R_{144})\ V_1)$ when the signal from the point "d" takes a lower level. In the above, $R_{144}$, $R_{146}$, and $R_{148}$ represent the resistances of the resistors 144, 146, and 148, respectively. It is understood from the foregoing that $V_2$ is higher than $V_c$ by $(R_{148}/R_{144})V_1$, so that, if this voltage difference makes the air-fuel ratio richer than the voltage $V_c$ by about 10%, the initiation of the operation of the system can be properly attained. The waveform of the signal appearing at the point "f" is shown in FIG. 5*f*. In this embodiment, time periods T1 and T2 in FIGS. b–f should be properly determined not to excessively enrich the air-fuel ratio in order not to deteriorate the catalytic converter. As for example, if the ratio of T1 to T2 is about 1/6, a deviation of the air-fuel ratio from that determined by the voltage $V_c$ is below about 2%. This deviation of the air-fuel ratio does not adversely affect the characteristic of the catalytic converter without failure of not initiating the operation of the system.

Figure 6:
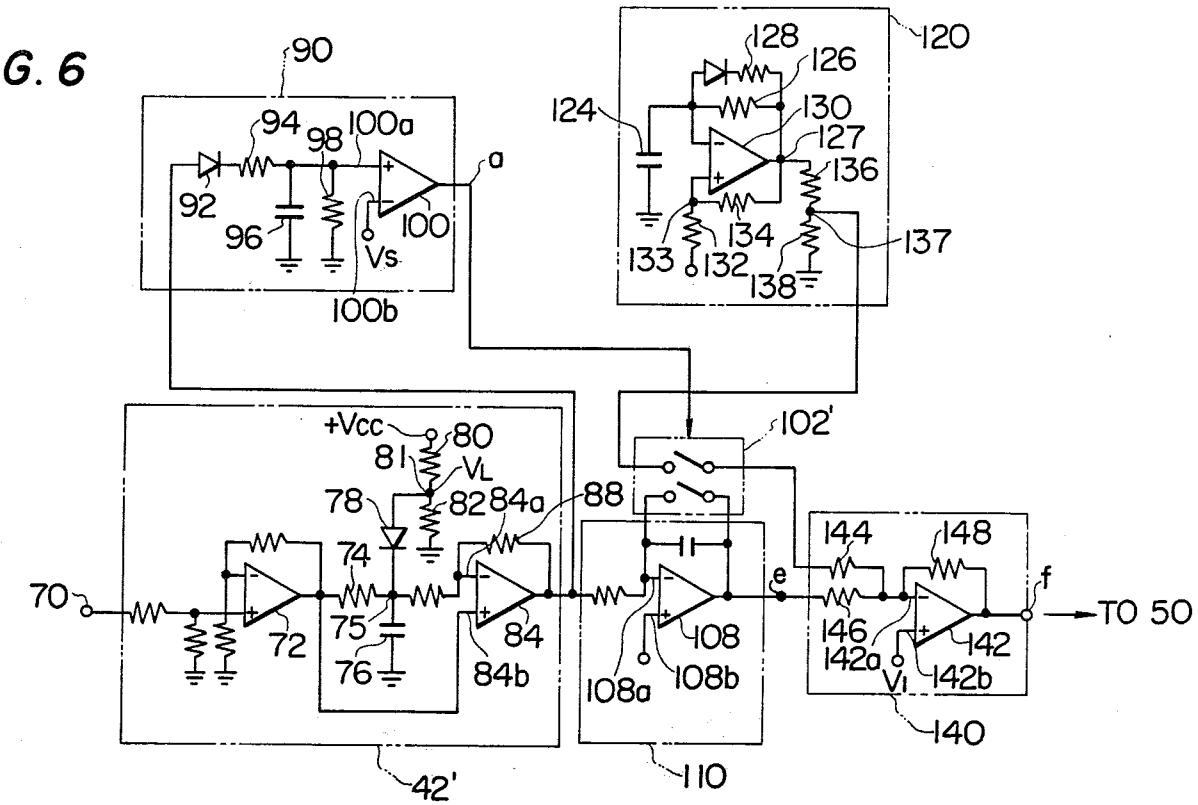
FIG. 6 is a second preferred embodiment of the present invention.

Reference is now made to FIG. 6, which illustrates a second preferred embodiment of the present invention. In brief, a difference between the first and the second preferred embodiments is that the pulse generator 120 always generates the train of pulses and the discriminator 90 controls supply of the pulses from the pulse generator 120 to the adder 140. To this end, as shown in FIG. 6, the transistor 122 of FIG. 4 is omitted and the switching means 102 of FIG. 4 is modified in such a manner as to feed the pulses from the pulse generator 120 to the adder 140 when the magnitude of the signal applied to the noninverting input terminal 100*a* is below the voltage $V_s$. The remaining circuit configuration of FIG. 6 is identical to that of FIG. 4 so that further description will be omitted for brevity.

In the first and the second preferred embodiments, the signal from the exhaust gas sensor 2 is averaged in its magnitude in the difference detecting circuit 42'. However, alternatively, the difference detecting circuit 42' can be modified such that the operational amplifier 84 receives the maximum value in one cycle of the signal from the sensor 2 or a constant value.

It is understood from the foregoing that, according to the present invention, when the operation of the system is inhibited while exhaust gas temperature is low, rich air-fuel mixture is intermittently fed to the engine in order to properly initiate the operation of the system.

What is claimed is:

1. A mixture control system for an internal combustion engine having an exhaust gas sensor for generating a signal representative of the concentration of a predetermined constituent of the exhaust gases from said engine, said signal having high and low voltage levels depending on the concentration of said constituent gas when said gas sensor is above a nominal operating temperature and having said low voltage level when said sensor is below said nominal operating temperature, and means for supplying mixture to said engine in response to a feedback control signal derived from said exhaust gas sensor, comprising:

first means for detecting when said exhaust gas sensor is below said nominal operating temperature;

second means for clamping the magnitude of said feedback control signal to a predetermined voltage level in response to said first means; and third means responsive to said first means for generating a plurality of unipolar electrical pulses during a single uninterrupted open loop period of operation which vary periodically between first and second voltage levels, the first voltage level corresponding to said predetermined voltage level of said clamped signal, said second voltage level corresponding to enrichment of said mixture, said electrical pulses fed to said mixture supplying means.

2. A mixture control system as claimed in claim 1, wherein said first means comprises means for detecting the presence of said low voltage signal derived from said exhaust gas sensor and means for detecting when the presence of said low voltage signal continues for a predetermined period of time.

3. A mixture control system as claimed in claim 1, wherein said first means comprises a timing circuit responsive to said signal derived from said exhaust gas sensor to develop a first voltage signal when said gas sensor signal is at said high voltage level and a second voltage signal when said gas sensor signal remains at said low voltage level over said predetermined period of time, and means for comparing said second voltage signal with a reference level.

4. A mixture control system as claimed in claim 1, wherein said first means comprises an averaging circuit responsive to said gas sensor signal to develop a signal representing a mean value of the voltage levels of said gas sensor signal and means for comparing said means value representative signal with a reference level to generate an output when said means value signal is below said reference level.

5. A mixture control system as claimed in claim 1, wherein the time said unipolar pulses remain at said first voltage level is greater than the time said pulses remain at said second voltage level.

6. A mixture control system as claimed in claim 5, wherein the ratio of the time said unipolar pulses remain at said first voltage level to the time said pulses remain at said second voltage level is approximately 6:1.

7. A mixture control system as claimed in claim 1, further comprising means for algebraically combining said unipolar and said clamped feedback control signal, the output of said combining means being supplied to said mixture supply means.

8. A mixture control system as claimed in claim 7, further comprising means for converting the output of said combining means into a train of pulses of which the pulse width is a function of said output of said combining means, and wherein said mixture supply means comprises a two-position control valve responsive to said train of pulses from said converting means.

9. A mixture control system as claimed in claim 8, further comprising an integral controller responsive to said gas sensor signal to develop a time integral signal which represents an integration of said gas sensor signal with respect to time, and wherein said second means clamps said time integral signal to said predetermined voltage level.

10. A mixture control system as claimed in claim 7, wherein said second means comprises a switching means responsive to said first means for disabling said integral controller and connecting an input of said integral controller to a voltage source.

* * * * *